US006449911B1

(12) United States Patent
Hudson

(10) Patent No.: US 6,449,911 B1
(45) Date of Patent: Sep. 17, 2002

(54) DECK JOIST FLASHING

(76) Inventor: Donald E. Hudson, 10680 Willow Valley Rd., Nevada City, CA (US) 95959

( * ) Notice: Subject to any disclaimer, the term of this patent is extended or adjusted under 35 U.S.C. 154(b) by 43 days.

(21) Appl. No.: 09/699,148

(22) Filed: Oct. 26, 2000

Related U.S. Application Data

(60) Provisional application No. 60/161,867, filed on Oct. 27, 1999.

(51) Int. Cl.[7] ..... E04B 1/32
(52) U.S. Cl. ..... 52/58; 52/716.2; 52/97
(58) Field of Search ..... 52/58, 408, 716.1, 52/716.2, 717.03, 716.8, 731.1, 741.3, 97

(56) References Cited

U.S. PATENT DOCUMENTS

| | | | | |
|---|---|---|---|---|
| RE28,870 | E | 6/1976 | Attaway | |
| 4,742,654 | A | 5/1988 | Cole | |
| 4,848,049 | A | 7/1989 | Hanson | |
| 4,858,399 | A | 8/1989 | Salato | |
| 4,969,250 | A | 11/1990 | Hickman | |
| 5,097,641 | A | 3/1992 | Hand | |
| 5,148,644 | A | 9/1992 | Weir | |
| 5,181,352 | A | 1/1993 | Friedman | |
| 5,280,692 | A | 1/1994 | Patey | |
| 6,189,279 | B1 * | 2/2001 | Fiechtl | 52/403.1 |
| 6,238,766 | B1 * | 5/2001 | Massett | 52/169.14 |

* cited by examiner

*Primary Examiner*—Beth A. Stephan
(74) *Attorney, Agent, or Firm*—Heisler & Associates

(57) ABSTRACT

Deck joist flashing 10 is provided which includes a top wall 20 extending between lateral edges 22 spaced apart by a width similar to a width of a joist J to be protected from coming into contact with water. Side walls 30 extend down from the lateral edges 22 of the top wall 20. Bottom edges 34 of each side wall 30 include a beveled wall 40 extending therefrom. Each beveled wall 40 extends diagonally away from the bottom edges 34 of the side wall 30 to a tip 44. The tips 44 of the two beveled walls 40 are spaced further from each other than the lateral edges 22 of the top wall 20 so that the tips 44 are spaced away from sides of the joist J by the flashing 10. In this way, water is directed away from surfaces of the joist J to preserve the joist J from deterioration associated with contact with water. A material forming the flashing 10 is sufficiently elastic, soft and flexible that fasteners can pass through the flashing without cracking and the flashing 10 can seal around the fastener to preclude water migration through fastener holes in the top wall 20. The material is sufficiently soft that it can be rolled-up into a roll 112 to take up lesser space when being stored or transported.

12 Claims, 3 Drawing Sheets

DECK JOIST FLASHING

This application claims benefit under Title 35, United States Code §119(e) of U.S. Provisional Application No. 60/161,867 filed on Oct. 27, 1999.

FIELD OF THE INVENTION

The following invention relates to flashing configured to be used on joists to shed water away from surfaces of the joists. More particularly, this invention relates to flashing which can be interposed between upper surfaces of joists and boards fastened to the joists, such as boards forming a surface of a deck and fastened to deck joists in residential construction projects.

BACKGROUND OF THE INVENTION

Decks are common in residential construction which provide a horizontal surface supported above ground in a manner which allows people and furnishings to safely rest upon the deck. Such decks typically include foundation piers extending up from the ground vertically with joists extending horizontally between the piers. Deck boards or other surface materials are fastened to tops of the joists, typically extending horizontally perpendicular to the joists, to provide the finished surface for the deck. For larger decks, girders can be provided extending horizontally between the piers with the joists resting upon the girders, rather than having the joists rest directly on the piers themselves.

While decks provide a valuable and enjoyable structure as part of a residential construction project, decks are particularly prone to deterioration due to environmental exposure of the deck components and pest infestation. Of the environmental influences that cause damage to decks, water exposure on the deck plays a major role. First, water can directly cause wood and other cellulosic material based building products to prematurely decay. Such water damage results initially from water coming into contact with the deck construction materials. The water damage is accelerated when the deck is constructed in a manner which makes the deck material slow to dry after having been exposed to the water. Secondarily, when the water comes in contact with the deck materials and is not allowed to fully dry, dry rot can occur. Dry rot is a fungus disease that causes timber to become brittle and crumble into powder.

A well constructed deck formed from wood or other cellulosic materials can be constructed to delay the damage the deck experiences due to water exposure. Particularly, it is known in the prior art to ensure that deck boards forming the deck are spaced apart sufficiently so that air can circulate between the deck boards and adjacent surfaces of the joists to thoroughly dry out the deck construction materials between rainy periods. Additionally, treatments are known, such as sealers, which can cause the water to be less readily absorbed into the building materials to preserve the materials from deterioration. However, these sealers and construction techniques typically only delay the deterioration of the deck.

Water shields are known for placement on floor joists to prevent the joists from coming into contact with water. For instance, U.S. Pat. No. 5,280,692 to Patey teaches a water shield and reinforcing member for floor joists which acts as a cover over an upper surface of the joist and is screwed to the joist through use of screws passing through holes in a top surface of the shield. Patey teaches use of wing members at bottom edges of downwardly extending portions of the shield which tend to cause water passing over the shield to be directed away from surfaces of the joist.

While the patent to Patey teaches a basic joist shielding structure, Patey suffers from numerous drawbacks. First, Patey teaches providing holes through a top of the shield for fastening to the joist. Such holes become locations where water damage and dry rot can be initiated in the underlying joist. Additionally, Patey teaches use of a material with a high modulus of elasticity to add strength to the joist member. Such high modulus of elasticity material would tend to crack and further expose the joist to water damage adjacent such cracks should the shield taught by Patey be stressed during construction or should screws or other fasteners need to be utilized passing through the Patey shield at a location other than where a hole is already provided. The high modulus of elasticity taught by Patey additionally requires that the Patey shield be provided in linear elongate segments. Many decks are sufficiently long that such shields would become difficult to store and transport to a job site, or else a gap between shorter linear segments would need to be provided.

Accordingly, a need exists for a deck joist flashing product which can have fasteners placed therethrough and which can seal around the fasteners to preclude water migration without requiring the pre-forming of holes therethrough. Such deck joist flashing would additionally benefit from being sufficiently soft to be collapsible into a smaller size transport and storage configuration.

SUMMARY OF THE INVENTION

The deck joist flashing of this invention prevents water from coming into contact with joists underlying boards forming a top surface of the deck so that the joists avoid deterioration associated with coming into contact with water. The flashing includes a horizontal top wall extending between parallel lateral edges. Side walls extend down from the lateral edges of the top wall. The side walls extend to beveled walls which extend diagonally away from each other to tips. The tips are spaced further from each other than a spacing between the lateral edges of the top wall. The top wall has a width similar to a width of the joist over which the flashing is to be placed. Hence, the tips of the flashing are spaced away from the sides of the joists and direct water away from the joist.

The flashing is formed from a material which has a high degree of flexibility and elasticity, such as 85 durometer PVC (polyvinyl chloride) plastic material. Such material is sufficiently soft that when screws or other fasteners pass through the top wall or other surfaces of the flashing, no cracks propagate away from the point of penetration by the fastener.

The flashing has surfaces thereof sufficiently thin and is formed from sufficiently flexible material that the flashing can be rolled-up into a roll for storage and transportation before use. The side walls can fold up adjacent the inside surface of the top wall and yet can maintain a bias for its geometry when initially formed, so that when the flashing is unrolled it returns to its original cross-sectional configuration.

OBJECTS OF THE INVENTION

Accordingly, a primary object of the invention is to provide deck joist flashing which shields deck joists from water migrating down from deck boards resting upon the joists.

Another object of the present invention is to provide flashing which can have fasteners pass therethrough without cracking the flashing or otherwise providing a hole through which water can migrate.

Another object of the present invention is to provide deck joist flashing which prevents the joist from experiencing water damage or dry rot.

Another object of the present invention is to provide deck joist flashing which is sufficiently elastic and flexible that it can be rolled-up into a roll and yet having sufficient memory so that when unrolled it returns to an original form.

Another object of the present invention is to provide deck joist flashing which can be sized to rest upon joists having different sizes.

Another object of the present invention is to provide deck joist flashing which has a continuous closed top surface for shielding an underlying joist from contact with water.

Another object of the present invention is to provide a deck joist flashing which is sufficiently elastic that it can expand somewhat to seal around and against a fastener passing therethrough when the flashing is compressed.

Another object of the present invention is to save natural timber resources by minimizing water contact in construction projects and delaying replacement.

Other further objects of the present invention will become apparent from a careful reading of the included drawing figures, the claims and detailed description of the invention.

BRIEF DESCRIPTION OF THE DRAWING FIGURES

FIG. 5 is a section view taken along lines 5—5 of FIG. 4.

FIG. 6 is a section view taken along lines 6—6 of FIG. 4.

FIG. 7 is a section view taken along lines 7—7 of FIG. 4.

FIG. 8 is a section view taken along lines 8—8 of FIG. 4.

DETAILED DESCRIPTION OF THE PREFERRED EMBODIMENT

Figure 1:
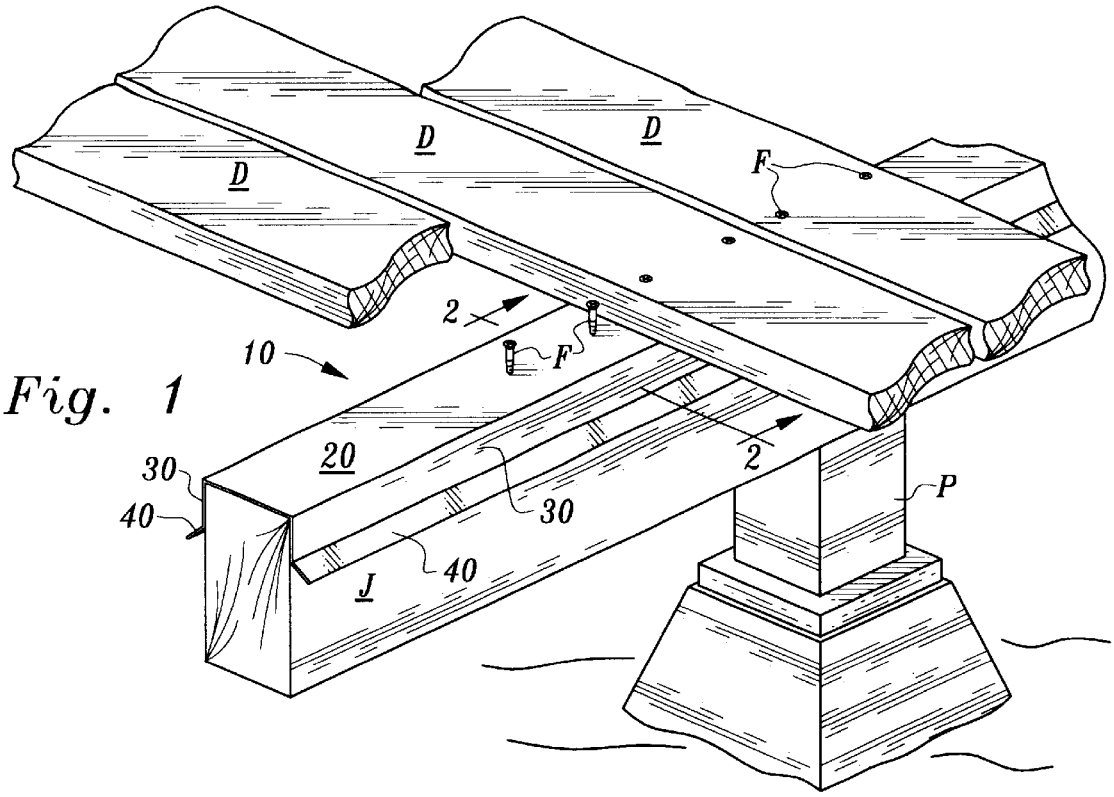
FIG. 1 is a perspective view of the deck joist flashing of this invention located upon a deck joist and with deck boards fastened to the joist and overlying the deck joist flashing of this invention.

Referring to the drawings, wherein like reference numerals represent like parts throughout the various drawing figures, reference numeral 10 is directed to the deck joist flashing of this invention. The flashing 10 is interposed between deck boards D and a joist J with a fastener F extending down through the deck board D, through the flashing 10 and into the joist J. The flashing 10 covers the joist J and prevents water from coming into contact with the joist J.

Figure 2:
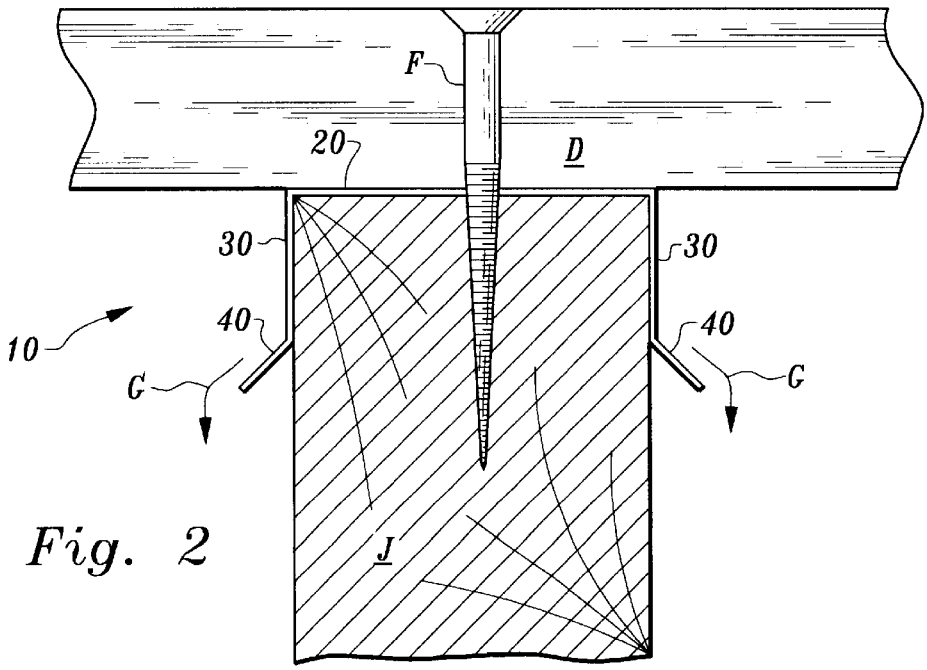
FIG. 2 is a section view taken along line 2–2 of FIG. 1 revealing cross-sectional details of the deck joist flashing of this invention when located upon a deck joist.
Figure 3:
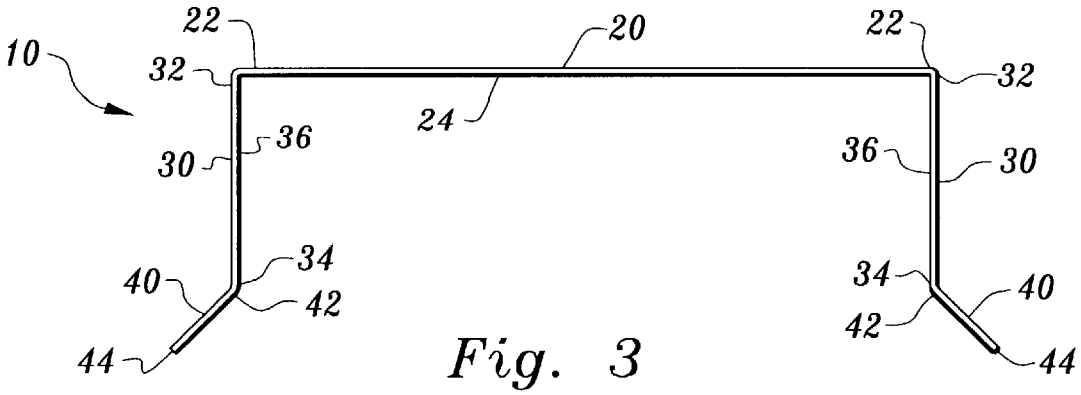
FIG. 3 is a cross-sectional view of a deck joist flashing of this invention in a wider configuration such as for resting upon "4×6" or "4×" construction materials forming the joists.

In essence, and with particular reference to FIG. 3, the deck joist flashing 10 includes a top wall 20 with a side wall 30 extending down from lateral edges 22 of the top wall 20. Each side wall 30 includes a beveled wall 40 which flairs out to a tip 44. The top wall 20 and side walls 30 cover the joist J and prevent water from contacting the joist J. The beveled wall 40 and tip 44 direct water sufficiently away from sides of the joist J so that the water is released and falls to the ground minimizing contact with the joist J (Arrow G of FIG. 2).

More particularly, and with continuing reference to FIG. 3, the particular details of the deck joist flashing 10 are provided. The deck joist flashing 10 is an elongate construct of preferably constant cross-sectional contour. This contour includes a horizontal top wall 20 extending between parallel lateral edges 22. The lateral edges 22 are spaced apart by a width of the top wall 20. The top wall 20 has an inside surface 24 which is oriented adjacent the joist J. Fasteners F pass through the top wall 20 (FIGS. 1 and 2) causing the top wall 20 to be sandwiched between the deck boards D and the joist J.

Each side wall 30 extends down from one of the lateral edges 22 of the top wall 20. A top edge 32 of each side wall 30 is adjacent the lateral edges 22 of the top wall 20. The side walls 30 extend down from the top edge 32 to a bottom edge 34. The side walls 30 each include a beveled wall 40 extending from the bottom edge 34 of each side wall 30. An inner surface 36 of each side wall 30 is located adjacent sides of the joist J and shields adjacent portions of the joist J from contact with water. While the side walls 30 are preferably oriented vertically and perpendicular to the top wall 20, if the joist J has a non-rectangular contour, such as "trapezoidal" or some other contour, the top wall 20 and side walls 30 can be modified to mirror the contour of the joist J so that the top wall 20 and side walls 30 remain adjacent the surfaces of the joist J or at least have a geometry which is larger than and can overlie the geometry of the upper portion of the joist J.

Each beveled wall 40 is similar in contour and extends down from the bottom edges 34 of the two side walls 30. An upper edge 42 of each beveled wall 40 is adjacent the bottom edge 34. The beveled walls 40 extend diagonally to a tip 44. Preferably, the beveled wall 40 is oriented at a 45° angle with respect to vertical and 135° opposed from the vertical orientation of the side walls 30. The angle at which the beveled wall 40 extends away from the side walls 30 can be modified depending on the length of the beveled wall 40 and the particular needs of the job.

Preferably, the top wall 20 has a width which comes in standard sizes matching typical widths of joists J. For instance, the top wall 20 can come in a 1.625 inch width to overlie 1.550 inch wide "2×" material or in a 3.575 inch wide configuration to overly 3.5 inch wide "4×" material. Note that "2×" material is typically in fact only 1.5 inches wide and "4×" material is typically only 3.550 inches wide and a tolerance of 0.075 is provided to allow the flashing 10 to be easily placed upon the joist J. If the joist J is provided with other dimensions, the flashing 10 can be provided in different matching dimensions to accommodate joists J of differing dimensions.

Preferably, the height of the side walls 30 from the top edge 32 down to the tip 44 is 1.5 inches. However, the side walls 30 could extend a greater or lesser distance depending on the needs of the user. To facilitate rolling-up of the flashing 10, it is desirable that the height of the side walls 30 be less than a width of the top wall 20, so that the side walls 30 can fold up against the inside surface 24 of the top wall 20 as discussed in detail below. If such a roll-up configuration is not used, a greater variety of side wall height to top wall width ratios can be accommodated. For wider top wall 20 flashing 10, it is most preferable that the side walls 30 have a height less than one-half of the width of the top wall 20 so that the side walls 30 can fold-up against the inside surface 24 of the top wall 20 without the side walls 30 overlapping at all.

Figure 8:
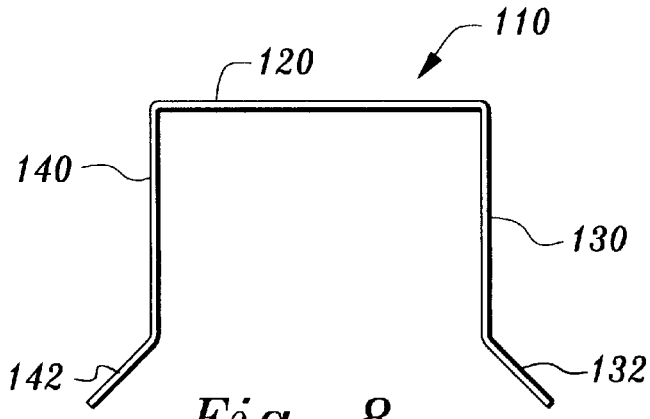

With particular reference to FIG. 8, a cross-sectional contour of alternative flashing 110 is shown. This alternative flashing 110 has side walls 130, 140 which are similar in height to the side walls 30 of the preferred embodiment but has a top wall 120 which has a narrower width than the top wall 20 of the flashing 10 of the preferred embodiment. Such alternative flashing 110 would be used with joists J having a narrower width but still include bevels 132, 142 at ends of the side walls 130, 140 opposite the top wall 120.

Figure 4:
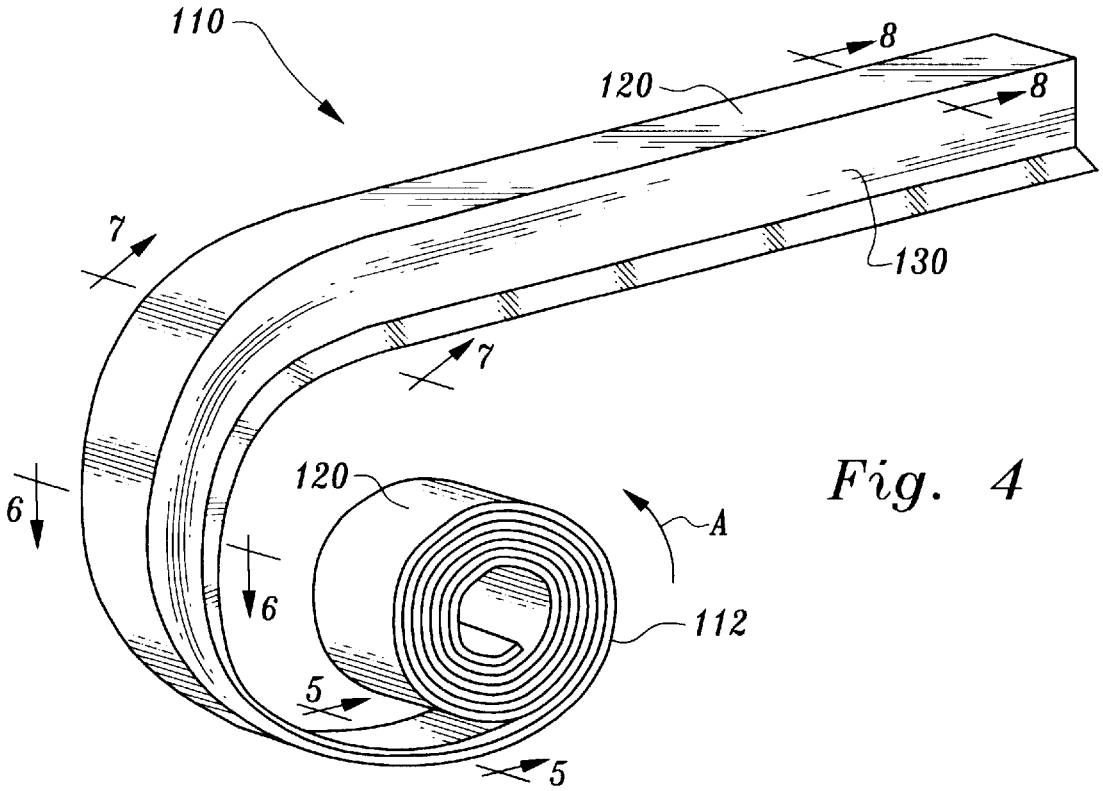
FIG. 4 is a perspective view of an alternative deck joist flashing geometry for "2×4" or "2×" construction materials showing how the deck joist flashing folds up and rolls-up into a roll for storage and transportation.
Figure 5:
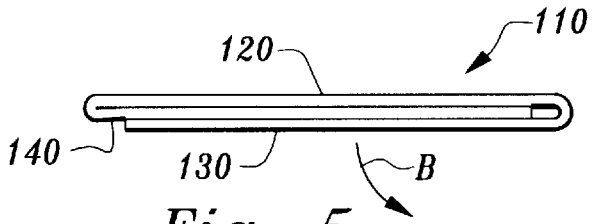
FIGS. 5–8 are section views showing the sequential phases of deploying the flashing from a rolled-up form to a deployed form.

While the flashing 10, 110 of this invention can effectively be formed from a variety of different materials, most preferably materials having very particular characteristics are utilized in forming the flashing 10, 110 so that the flashing 10, 110 can have fasteners F pass therethrough without cracking the flashing 10 and without requiring drilling of holes through the flashing 10, 110; to facilitate rolling-up of the flashing 10, 110 for storage and transport, as depicted in FIG. 4; and to be elastically deformable to seal against a fastener passing therethrough.

Specifically, the material forming the flashing 10, 110 is preferably a polyvinyl chloride (PVC) hydrocarbon plastic which has a durometer shore "A" (+3), 10 sec. score of 85 (according to ASTM NO. D-2240). Other most preferred characteristics of this material are as follows:

| | | ASTM NO. |
|---|---|---|
| Durometer Shore "A" (+3), 10 sec. | 85 | D-2240 |
| Specific Gravity (+.02) | 1.46 | D-792 |
| Tensile Strength (psi) | 1810 | D-412 |
| Ultimate Elongation (%) | 320 | D-412 |
| 100% Modulus (psi) | 950 | D-412 |
| Brittle Temperature (° C.) | −27 | |
| Tear Strength (lb/in) | 260 | D-1004 |
| Volatility, Activated Carbon (%) | 4.5 | D-1203, 24 hr. @ 90° C. |
| Soapy Water Extraction, % Wt. Loss | .74 | |
| Oil Extraction, % Wt. Loss | 12.5 | |
| Hexane Extraction, % Wt. Loss | 26 | |

While this 85 durometer PVC is most preferred for the material forming the flashing 10, 110, other materials can be utilized. Alternative materials would benefit from being sufficiently flexible and elastic so that the beneficial features of this invention are provided. Specifically, the material should have sufficient flexibility and elasticity so that when a screw, nail or other fastener passes through the top wall 20 of the flashing 10, even in cold weather, cracks will not form adjacent where the fastener F penetrates the top wall 20.

The material forming the flashing 10 preferably is sufficiently elastic and flexible that the side walls 30 can be folded up against the inside surface 24 of the top wall 20 and the flashing 10 can be rolled-up (FIG. 4, along arrow A) so that the flashing 10 occupies a smaller space for storage and transportation. The material preferably has an elastic limit which is not exceeded when the side walls 30 are folded up against the top wall 20 so that when the flashing 10 is unrolled the side walls 30 return back to their bias orientation which they originally had before being rolled-up and with the beveled walls 40 configured as originally formed for deflection of water away from the joist J. It is not a requirement that the material immediately spring back into its original configuration when unrolled, but rather need merely eventually return to its original configuration. In fact, it is somewhat desirable that the side walls 30 only slowly return to a vertical orientation perpendicular to the top wall 20. In this way, the side walls 30 will tend to grab the joist J when initially being unrolled so that the flashing 10 has a self-clamping attribute allowing a construction worker to more easily deploy the flashing 10 onto the deck joist J without requiring separate clamping or other attachment devices.

With particular reference to FIGS. 4-8, details of the unrolling of the flashing 10, 110 is described in detail. FIG. 4 depicts the alternative flashing 110 initially in the form of a roll 112 and being deployed into its elongate form. The flashing 10 of the preferred embodiment could similarly be rolled-up into a roll and then later deployed into an elongate form. Initially, the flashing 110 would typically be formed by extrusion through a dye having an opening matching the contour shown in FIG. 8. Alternatively, a mold having the desired structure can be utilized or other manufacturing technique can be utilized to form the alternative flashing 110. The side walls 130, 140 are then folded up against the top wall 120 and the alternative flashing 110 rolled-up into the roll 112. While in the roll 112, very little space is wasted so that a greater amount of the alternative flashing 110 can be stored in a given amount of space and transported within a given amount of space.

Figure 6:
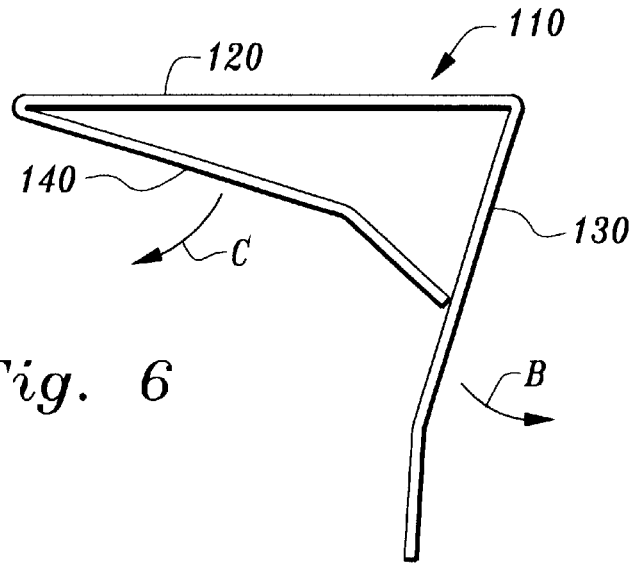
Figure 7:
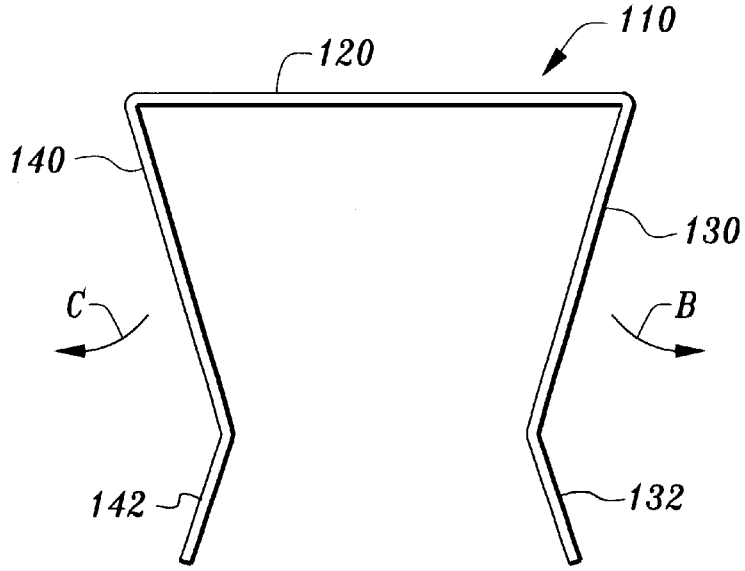

When a user desires to place the flashing 110 on a joist J the following procedure is followed. Initially, the user allows the flashing 110 to be unrolled out of the roll 112 (FIG. 4). The first side wall 130 and second side wall 140 are oriented parallel with the top wall 120 with the first side wall 130 outside of the second side wall 140. Note that when the flashing 10 of the preferred embodiment is rolled-up, the side walls 30 would not need to overlap each other. The first side wall 130 is then pivoted away from horizontal along arrow B (FIGS. 5–7) and the second side wall 140 is pivoted away from horizontal along arrow C (FIGS. 6 and 7). This deployment of the side walls 130, 140 can either happen automatically under the elastic forces of the material itself, causing the material to spring back to its original form, or can be performed manually by the user spreading the first side wall 130 and second side wall 140 away from the top wall 120. Once the side walls 130, 140 have been rotated 90°, the flashing 110 has achieved its elongate form (FIG. 8) and is ready to be attached to a joist J. Typically, rolls of flashing 10, 110 would be provided in standard lengths. Hence, a knife or other cutting tool would be utilized to cut the flashing 10, 110 to a length which matches a length of the joist J to be covered.

With particular reference to FIGS. 1 and 2, details of the use of the flashing 10 in the construction of a deck are described. While the flashing 10 can be utilized in structures other than decks, the use of the flashing 10 is illustrated in conjunction with the construction of a standard outdoor residential construction deck. Such a deck includes a foundation pier P extending up from the ground with joists J extending horizontally and resting upon the piers P. Alternatively, girders can extend horizontally and rest upon the pier P with the joists J resting upon such girders and typically oriented perpendicular to such girders. When girders are utilized, flashing 10 can be utilized both on the girders and on the joists J to protect both the joists J and the girders from deterioration associated with contact with water.

Once the joists J have been placed in their desired position upon the piers P, the flashing 10 is oriented overlying the top of the joists J. In this configuration, the top wall 20 is oriented horizontally overlying the top of the joists J and the side walls 30 extend vertically down adjacent sides of the joists J. Deck boards D are then placed on top of the top wall 20 of the flashing 10. Typically, the deck boards D are spaced slightly away from each other to allow ventilation between the deck boards D.

Fasteners F are utilized to fasten the deck boards D to the joists J. Such a fastening procedure typically includes rotating a screw through the deck board D, through the top wall 20 of the flashing 10 and into the joist J. If other fasteners are utilized rather than screws, such as nails, an appropriately modified procedure would be followed. For instance, nails would be driven through the deck board D, through the top wall 20 of the flashing 10 and into the joist J.

When the deck is exposed to rain, or other sources of water contact with the deck boards D, water is allowed to migrate between the deck boards D and fall down beneath the deck. Water which passes between the deck boards D adjacent the joists J will impact the top wall 20 of the flashing 10. Such water will collect and then migrate to the side walls 30 where adhesion forces will tend to cause the water to remain in contact with the side walls 30 and migrate down to the beveled wall 40. The beveled wall 40 will deflect the water out away from sides of the joists J until the water reaches the tip 44 where the water releases from the beveled wall 40 and falls to the ground clear of the sides of joist J (arrow G of FIG. 2). The joists J are thus shielded from coming into contact with water and hence deterioration of the joists J, caused by coming into contact with water, is avoided.

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. Flashing for overlying a joist to shield the joist from water contact, the flashing comprising in combination:

an elongate top wall having a width between two lateral edges at least as great as a width of the joist to be shielded;

two side walls, each said side wall extending down from a different one of said two lateral edges of said top wall;

two tips, one of said two tips located on one of said side walls at an edge spaced from said top wall, the other of said two tips located on the other of said side walls at an edge spaced from said top wall, said tips of said side walls located further from each other than said width of said top wall between said two lateral edges;

said top wall free of openings;

wherein said top wall is formed of a sufficiently soft material that a fastener can penetrate said top wall without inducing crack propagation in said top wall adjacent the fastener; and wherein said material forming said top wall is sufficiently soft to allow said flashing to roll-up with said top wall overlapping itself.

2. The flashing of claim 1 wherein said material forming said flashing is the same material for both said top wall and said two side walls, said material having a durometer shore "A" (+3), ten second test score between 70 and 100.

3. The flashing of claim 2 wherein said material forming said flashing has a durometer shore "A" (+3), ten second score of approximately 85.

4. A method for shielding joists within a structure during construction and thereafter, including the steps of:

placing one of the joists substantially horizontally where desired within the structure;

providing joist flashing having an elongate top wall having a width between two lateral edges at least as great as a width of the joist to be shielded; two side walls, each said side wall extending down from a different one of said two lateral edges of said top wall; two tips, one of said two tips located on one of said side walls at an edge spaced from said top wall, the other of said two tips located on the other of said side walls at an edge spaced from said top wall, said tips of said side walls located further from each other than said width of said top wall between said two lateral edges;

placing the flashing over a top surface of the joist with the top wall of the flashing adjacent the top surface of the joist and the side walls of the flashing adjacent side surfaces of the joist;

locating a board over the joist and the flashing with the top wall of the flashing between the board and the joist;

passing a fastener from a top of the board, through the board, through the flashing and at least partially into the joist;

wherein said providing step includes configuring the flashing top wall to be non-foraminous;

wherein said providing step includes forming the flashing from a material which is sufficiently soft to allow the fastener to penetrate the flashing without inducing cracking of the flashing;

compressing the top wall of the flashing between the board and the joist by action of the fastener passing through the board, the top wall of the flashing and the joist; and sealing the flashing around the fastener when the flashing is compressed.

5. The method of claim 4 wherein said providing step includes configuring the flashing from sufficiently soft material to allow the top wall of the flashing to roll-up overlapping itself; and wherein said placing step includes the step of unrolling the flashing from a rolled-up form overlapping itself into a linear form.

6. The method of claim 5 wherein said providing step includes forming the flashing from sufficiently soft material to allow the side walls of the flashing to resiliently fold up against the top wall of the flashing; and wherein said placing step includes the step of unfolding the side walls away from the top wall.

7. The method of claim 6 wherein said providing step includes forming the flashing from a material which is biased toward an orientation with the side walls perpendicular to the top wall, and which only slowly returns from a folded up orientation with the side walls adjacent the top wall to the biased position for the flashing, such that the side walls initially resist unfolding after having been folded up adjacent the top wall; and holding the flashing adjacent the joist by unfolding the side walls and placing the side walls adjacent side surfaces of the joist with the side walls exerting a clamping force against the side surfaces of the joist while said flashing slowly returns to the biased orientation.

8. Flexible flashing for overlying a joist to shield the joist from water contact, the flexible flashing comprising in combination:

an elongate top wall having a width between two lateral edges at least as great as a width of the joist to be shielded;

two side walls, each said side wall extending down from a different one of said two lateral edges of said top wall;

two tips, one of said two tips located on one of said side walls at an edge spaced from said top wall, the other of said two tips located on the other of said side walls at an edge spaced from said top wall, said tips of said side walls located further from each other than said width of said top wall between said two lateral edges; and wherein said material forming said top wall is sufficiently soft to allow said flashing to roll-up with said top wall overlapping itself.

9. The flexible flashing of claim 8 said material forming said flexible flashing is sufficiently flexible to allow said side walls to fold up against said top wall without cracking said flashing, said side walls maintaining said tip spacing greater than said width of said top wall when said flashing is unrolled and said side walls are unfolded.

10. The flexible flashing of claim 9 wherein said material forming said flexible flashing has a durometer shore "A" (+3), ten second score of between 70 and 100.

11. The flexible flashing of claim 8 wherein said top wall is formed of a sufficiently soft material that a fastener can penetrate said top wall without inducing crack propagation in said top wall adjacent the fastener.

12. The flexible flashing of claim 8 wherein said top wall is free of openings.

* * * * *